US009010903B2

(12) United States Patent
Yokozawa et al.

(10) Patent No.: US 9,010,903 B2
(45) Date of Patent: Apr. 21, 2015

(54) INK JET PRINTING APPARATUS AND INK JET PRINTING METHOD

(75) Inventors: Taku Yokozawa, Yokohama (JP); Yuhei Oikawa, Yokohama (JP); Daigoro Kanematsu, Yokohama (JP); Kazuo Suzuki, Yokohama (JP); Satoshi Hayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1268 days.

(21) Appl. No.: 12/128,319

(22) Filed: May 28, 2008

(65) Prior Publication Data

US 2008/0297552 A1 Dec. 4, 2008

(30) Foreign Application Priority Data

Jun. 4, 2007 (JP) ..... 2007-148631

(51) Int. Cl.
*B41J 29/38* (2006.01)
*B41J 29/393* (2006.01)
*B41J 2/045* (2006.01)

(52) U.S. Cl.
CPC ..... *B41J 29/393* (2013.01); *B41J 2/04515* (2013.01); *B41J 2/04563* (2013.01); *B41J 2/04573* (2013.01); *B41J 2/0458* (2013.01)

(58) Field of Classification Search
USPC ..... 347/14, 17
See application file for complete search history.

(56) References Cited

U.S. PATENT DOCUMENTS

| | | | | |
|---|---|---|---|---|
| 5,877,785 | A | 3/1999 | Iwasaki et al. | |
| 6,655,772 | B2 | 12/2003 | Danzuka et al. | |
| 2005/0264609 | A1 * | 12/2005 | Kubo et al. | 347/54 |
| 2007/0229567 | A1 | 10/2007 | Hayashi et al. | |

FOREIGN PATENT DOCUMENTS

| | | | |
|---|---|---|---|
| JP | 2001-113678 | | 4/2001 |
| JP | 2002-355959 | | 12/2002 |
| JP | 2005-74759 | A | 3/2005 |
| JP | 2005-349639 | A | 12/2005 |
| JP | 2006-341570 | A | 12/2006 |

OTHER PUBLICATIONS

Office Action dated Aug. 24, 2012, in Japanese Application No. 2008-147203.

* cited by examiner

*Primary Examiner* — Uyen Chau N Le
*Assistant Examiner* — Chad Smith
(74) *Attorney, Agent, or Firm* — Fitzpatrick, Cella, Harper & Scinto

(57) ABSTRACT

An ink jet printing apparatus inhibits the temperature of a print head from increasing excessively while preventing significant density or hue unevenness from occurring in images, without the need for a complicated structure or complicated control. Thus, the temperature of the print head is detected, and the number of scans in which the print head is to stand by until start of scanning and a standby time for each of the set number of scans by the print head are set, on the basis of the detected temperature.

39 Claims, 8 Drawing Sheets

| HEAD TEMPERATURE (TH℃) | SET SCAN COUNT (n) | STANDBY TIME SETTING | | | | | | | |
|---|---|---|---|---|---|---|---|---|---|
| | | FIRST SCAN | SECOND SCAN | THIRD SCAN | FOURTH SCAN | FIFTH SCAN | SIXTH SCAN | SEVENTH SCAN | EIGHTH SCAN |
| 66°C～70°C | 6 | 0.1sec | 0.1sec | 0.3sec | 0.3sec | 0.1sec | 0.1sec | | |
| 71°C～75°C | 8 | 0.2sec | 0.2sec | 0.3sec | 0.3sec | 0.2sec | 0.2sec | 0.1sec | 0.1sec |
| 76°C～ | 8 | 0.3sec | 0.3sec | 0.4sec | 0.4sec | 0.3sec | 0.3sec | 0.1sec | 0.1sec |

| HEAD TEMPERATURE (TH℃) | SET SCAN COUNT (n) | STANDBY TIME SETTING | | | | | | | |
|---|---|---|---|---|---|---|---|---|---|
| | | FIRST SCAN | SECOND SCAN | THIRD SCAN | FOURTH SCAN | FIFTH SCAN | SIXTH SCAN | SEVENTH SCAN | EIGHTH SCAN |
| 66℃～70℃ | 4 | 0.3sec | 0.3sec | 0.3sec | 0.3sec | | | | |
| 71℃～75℃ | 6 | 0.3sec | 0.3sec | 0.3sec | 0.3sec | 0.3sec | 0.3sec | | |
| 76℃～ | 8 | 0.3sec | 0.3sec | 0.3sec | 0.3sec | 0.3sec | 0.3sec | 0.3sec | 0.3sec |

FIG.4

| | OPTICAL DENSITY DIFFERENCE | HEAD TEMPERATURE (℃) |
|---|---|---|
| COMPARATIVE EXAMPLE 1 | - | 78 |
| COMPARATIVE EXAMPLE 2 | Δ0.06 | 69 |
| EXAMPLE | Δ0.02 | 71 |

FIG.5

| HEAD TEMPERATURE (TH℃) | SET SCAN COUNT (n) | STANDBY TIME SETTING | | | | | | | |
|---|---|---|---|---|---|---|---|---|---|
| | | FIRST SCAN | SECOND SCAN | THIRD SCAN | FOURTH SCAN | FIFTH SCAN | SIXTH SCAN | SEVENTH SCAN | EIGHTH SCAN |
| 66°C～70°C | 6 | 0.1sec | 0.1sec | 0.3sec | 0.3sec | 0.1sec | 0.1sec | | |
| 71°C～75°C | 8 | 0.2sec | 0.2sec | 0.3sec | 0.3sec | 0.2sec | 0.2sec | 0.1sec | 0.1sec |
| 76°C～ | 8 | 0.3sec | 0.3sec | 0.4sec | 0.4sec | 0.3sec | 0.3sec | 0.1sec | 0.1sec |

FIG.6

| HEAD TEMPERATURE (TH℃) | SET SCAN COUNT (n) | STANDBY TIME SETTING | | | | | | | |
|---|---|---|---|---|---|---|---|---|---|
| | | FIRST SCAN | SECOND SCAN | THIRD SCAN | FOURTH SCAN | FIFTH SCAN | SIXTH SCAN | SEVENTH SCAN | EIGHTH SCAN |
| 66℃～70℃ | 4 | 0.3sec | 0.3sec | 0.3sec | 0.3sec | | | | |
| 71℃～75℃ | 6 | 0.3sec | 0.3sec | 0.3sec | 0.3sec | 0.3sec | 0.3sec | | |
| 76℃～79℃ | 8 | 0.3sec | 0.3sec | 0.3sec | 0.3sec | 0.3sec | 0.3sec | 0.3sec | 0.3sec |
| 80℃ OR HIGHER | 1 | 1.0sec | | | | | | | |

FIG.8

INK JET PRINTING APPARATUS AND INK JET PRINTING METHOD

BACKGROUND OF THE INVENTION

1. Field of the Invention

The present invention relates to a printing apparatus that ejects ink from a print head to print a print medium, and a relevant printing method, and specifically, to a printing apparatus that controls the temperature of the print head, which is increased by ejection of the ink, and a relevant printing method.

2. Description of the Related Art

With the recent prevalence of computers and the Internet, printing apparatuses such as printers, copiers, and facsimile machines have spread rapidly to offices and general homes as output instruments that output images. Main printing methods adopted for these printing apparatuses include an electrophotographic method, an ink jet method, and a thermal method. Printing apparatuses adopting the ink jet method (ink jet printing apparatuses) can print media composed of various materials such as clothes, corrugated fiberboards, earthenware, and metal. The ink jet printing apparatus can also print not only planar media but also media with recesses and protrusions or a curved surface and edges of the media. The ink jet printing apparatus is thus commonly applied not only to personal use but also to business use. Furthermore, the ink jet printing apparatus has various advantages; the ink jet printing apparatus allows the size of a print head to be relatively easily reduced, allows high-resolution images to be printed at high speeds, requires low running costs, is quiet during printing, and can print color images using a simple configuration.

Currently known print heads mounted in the ink jet printing apparatus use electrothermal converting elements (heaters) or electromechanical converting elements such as piezo elements. Print heads of a type that utilizes thermal energy to eject ink are manufactured by making electrothermal converters and electrodes on a board by means of a semiconductor manufacturing process and then forming liquid path walls, top plates, and the like. This makes it possible to relatively densely manufacture individual print elements (also referred to as nozzles or ejection ports) that allow ink to be ejected as droplets. As a result, the apparatus can be made more compact. Moreover, the print head utilizing thermal energy to eject ink is excellent in ejection response frequency and suitably meets the recent demand for fast printing of high-resolution images. The print head is generally configured to include a plurality of densely integrated and arranged print elements (nozzles) each comprising a liquid path through which ink is supplied and an electrothermal converting element that subjects the ink in the liquid path to film boiling.

However, since the print head having the plurality of densely arranged print elements allows the electrothermal converting elements provided in the respective print elements to rapidly generate heat and thus energy for ejection, repeated ejections cause heat to be accumulated in the print head. The accumulated heat may pose a problem.

For example, an increasing quantity of accumulated heat raises the temperature of the ink in a common liquid chamber that temporarily stores the ink to be supplied to each of the liquid paths. A dissolved gas thus precipitates in the ink. Moreover, small bubbles generated in the individual liquid paths grow gradually as more heat is accumulated. Bubbles soon appear in the common liquid chamber, which is in communication with the liquid paths. Then, these large bubbles obstruct the feeding of the ink from the ink tank to the common liquid chamber or from the common liquid chamber to each liquid path as well as the ejection of the ink through ejection ports in the respective print elements. When an insufficient amount of ink droplets are ejected through the individual print elements even with the application of a voltage pulse to the electrothermal converting elements in accordance with image data, this condition is generally called non-ejection. In the ink jet print head, an excessive increase in temperature may result in non-ejection to degrade image quality or damage the print head. Such a heat accumulation problem more frequently occurs when an attempt is made to achieve faster printing or to output images of a higher resolution. This is because in this case, the print head with the ejection ports densely arranged therein is driven at a high frequency.

A method is known which, to avoid possible defects resulting from the above-described heat accumulation problem, detects the temperature of the print head during printing and compares the detected temperature with a predetermined threshold to control printing operations. For example, if the detected temperature is higher than the threshold, the driving frequency (ejection frequency) of the print head may be reduced to inhibit heat accumulation. For a serial type ink jet printing apparatus that forms an image by intermittently repeating main scanning of the print head and sub-scanning of a print medium, an effective method is to set a standby time for the start of the next print scan to allow the print head to cool down (Japanese Patent Laid-Open No. 2002-355959).

A method has also been disclosed which estimates the temperature of the print head expected to be detected after the completion of the next main scan according to a current temperature of the print head and the data of the image printed by the next main scan, and sets the standby time according to the estimated temperature (Japanese Patent Laid-Open No. 2001-113678).

The above-described methods make it possible to inhibit the temperature of the print head from increasing excessively. Thus, the above-described methods make it possible to avoid disadvantageous unstable ink ejections that affect image quality or damage the print head.

However, the method of controlling the driving frequency of the print head as described above can inhibit the print head from increasing excessively but poses a new problem described below. That is, when the method is adopted which reduces the driving frequency (ejection frequency) if the detected temperature is higher than the threshold, the speed of the print head relative to a print medium needs to be also reduced in association with the driving frequency of the print head. Performing control such that the driving frequency and relative speed are thus changed within the same page requires the provision of a complicated driving mechanism configuration as well as a driving control circuit. This disadvantageously increases the costs of the whole apparatus.

In contrast, no very complicated configuration is required for the method of setting the standby time between the scans as shown in Japanese Patent Laid-Open Nos. 2002-355959 and 2001-113678. However, this method has been found to affect images printed with the standby time set between each print scan and the succeeding print scan. Specifically, disadvantageously, the density or hue of an area printed with the standby time set between the print scans may be different from that of the other areas. The difference may be perceived as density or hue unevenness on the image.

Now, explanation will be given of the cause of a phenomenon such as the density or hue unevenness which may occur in an ink jet printing apparatus using multipass printing. The print head mounted in the ink jet printing apparatus has a plurality of print elements densely arranged therein. Ink is ejected through the individual print elements in accordance with image data. However, the plurality of print elements may vary to some degree in connection with the process of manufacturing the print head. Consequently, it is difficult to set all the print elements to eject exactly the same amount of ink in exactly the same direction. When an image is printed by one print scan performed by the print head with the varying print elements, the ejection characteristics of the individual print elements are significantly reflected in the image. Thus, image defects such as stripes and unevenness are visually perceived. The multipass printing method is adopted to reduce such image defects.

With the multipass printing method, image data that can be printed by the print head during one main scan is divided into a plurality of pieces. An image is formed by a plurality of main scans with a predetermined amount of sub-scan sandwiched between the main scans. That is, the multipass printing method uses a plurality of print elements to form a line that can otherwise be printed by one print element during one main scan, during a plurality of main scans. Thus, the adverse effects, on this line, of the ejection characteristics of each print element are reduced; the ejection characteristics of the print elements are distributed. This makes extreme stripes or unevenness unlikely to occur in the image as a whole. Therefore, a smooth image can be obtained.

The multipass printing method allows the number of passes to be optionally set. For example, a multipass printing method for two passes divides image data that can otherwise be printed by one main scan into two pieces so that the corresponding image is formed by two main scans. A multipass printing method for N passes divides image data that can otherwise be printed by one main scan into N pieces so that the corresponding image is formed by N main scans. The increased value of N reduces the adverse effects of the ejection characteristics of one print element on one line, smoothing the entire image.

With the multipass printing method, the density of the printed image varies depending on whether or not duration varies among the N main scans. If two droplets of ink are applied to same position on a print medium, how the first and second ink droplets applied to the print medium permeate the print medium varies depending on how the first ink droplet permeates the print medium when the second ink droplet is applied to the print medium. Thus, the density of the print image varies depending on the level of permeation of the ink. That is, the standby time between each main scan and the next main scan makes the density or hue of a part of the image printed by these print scans different from that of the other parts of the image. This phenomenon occurs differently depending on the type of the ink applied or the type of the print media applied. However, the difference in duration has been found at least to affect the image density or hue.

Thus, with the method of varying the standby time between the print scans depending on whether the detected temperature of the print head exceeds the threshold, only the area printed and scanned after the elapse of many standby time periods exhibits a density and a hue that are different from those of the other areas; this is disadvantageously viewed as unevenness. This problem may occur not only in the case of multicolor printing but also in monochrome printing. That is, in the case of monochrome printing, density unevenness may occur. In the case of multicolor printing, density and hue unevenness may occur.

SUMMARY OF THE INVENTION

The present invention is made in view of the above-described problems. That is, an object of the present invention is to provide an ink jet printing apparatus that can reduce possible density or hue unevenness caused by an increase in the temperature of a print head without the need for a complicated structure or complicated control, as well as a relevant ink jet printing method.

To accomplish this object, an ink jet printing apparatus according to the present invention has a configuration described below.

A first aspect of the present invention provides an ink jet printing apparatus that allows a print head to eject ink for printing, the apparatus comprising: a scanning unit that allows the print head to perform a plurality of scans relative to the same area on a print medium; a detector that detects temperature of the print head; and a setting unit that sets the number of scans in which the print head is to stand by until start of scanning, on the basis of the temperature detected by the detector.

A second aspect of the present invention provides a printing method of allowing a print head comprising a print element to eject ink while performing scanning for printing, the method comprising steps of: detecting temperature of the print head; and setting number of scans in which the print head is to stand by until start of scanning and a standby time for each of the set number of scans by the print head, on the basis of the detected temperature.

According to the present invention, even with an increase in the temperature of the print head during printing, the standby time is distributively set for each of the plurality of the scans to be subsequently started. This prevents significant hue or density unevenness from occurring between areas that are completed by a plurality of scans and printed during the respective print scans.

Further features of the present invention will become apparent from the following description of exemplary embodiments (with reference to the attached drawings).

BRIEF DESCRIPTION OF THE DRAWINGS

FIG. 4 is a diagram illustrating a setting table for standby time according to a first embodiment of the present invention;

FIG. 5 is a diagram showing the temperature of a print head reached when an A0-sized image of 100% print rate was printed by four passes using the printing apparatus according to the embodiment of the present invention as well as a difference in optical density between an image area formed by performing standby control using the printing apparatus according to the embodiment of the present invention and an image area printed without performing the standby control;

FIG. 6 is a diagram illustrating a setting table for standby time according to a second embodiment of the present invention;

FIG. 8 is a diagram illustrating a setting table for standby time according to the third embodiment of the present invention.

DESCRIPTION OF THE EMBODIMENTS (First Embodiment)

A preferred embodiment of the present invention will be described below in detail with reference to the drawings. In the specification, the term "printing" includes not only the formation of meaningful information such as characters or figures on a print medium, but also the formation of meaningless information on a print medium. The term "print medium" means not only paper, used in common printing apparatuses, but also other materials capable of receiving ink, such as a cloth, a plastic film, a metal plate, glass, ceramics, wood, or leather. The term "ink" should be broadly interpreted similarly to the definition of the term "printing", and means a material applied onto the print medium to form an image, a pattern, or the like.

Figure 1:
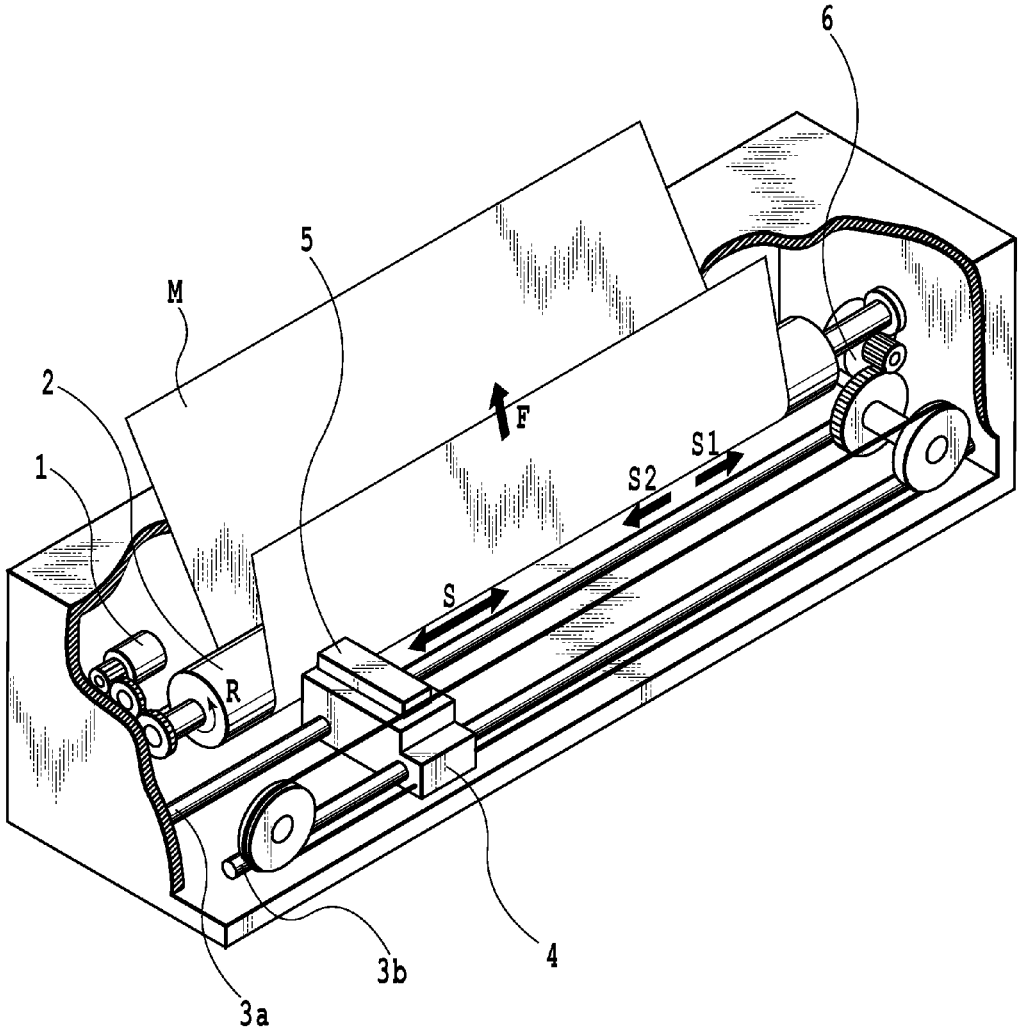
FIG. 1 is a schematic perspective view illustrating an internal mechanism of an ink jet printing apparatus that is applicable to an embodiment of the present invention.

FIG. 1 is a schematic perspective view illustrating an internal mechanism of an ink jet printing apparatus that is applicable to the present embodiment. In FIG. 1, reference numeral 1 denotes a conveying motor. The conveying motor 1 drivingly rotates a platen roller 2 in the direction of arrow R to convey a print medium M in the direction of arrow F. Guide shafts 3*a* and 3*b* are disposed in a direction orthogonal to the conveying direction F (sub-scanning direction) of the print medium M. A carriage 4 (scanning means) with an ink jet print head 5 mounted thereon is driven by a carriage motor 6 to reciprocate (reciprocating scan) in the direction of arrow S in FIG. 1 while being guided and supported by the guide shafts 3*a* and 3*b*. The print head 5, mounted on the carriage 4, ejects ink in accordance with print data during the moving scan of the carriage 4, to print the print medium. The present embodiment adopts what is called a bidirectional printing method in which the ink is ejected to print on the print medium both when the print head 5 moves along a forward path and when the print head 5 moves along a backward path. An operation in which the print head 5 prints the print medium by ejecting the ink while performing scanning is hereinafter referred to as a print scan. When the print head 1 performs one print scan, the print medium M is conveyed by a predetermined amount by the conveying motor 1.

The ink jet print head 5 applied to the present embodiment has 1,280 ejection ports arranged therein at a pitch of 1,200 dpi (dots/inch; a reference value) in a sub-scanning direction. An electrothermal converter is provided in an ink channel (liquid path) that is in communication with each of the ejection ports; the electrothermal converter generates heat in response to an electric signal generated in accordance with image data. Heat generated by the electrothermal converter locally heats the ink to cause film boiling. The resultant pressure causes the ink to be ejected through the ejection port. In the description below, the following are collectively called a nozzle (print element): the ejection port, through which the ink is ejected, the liquid path, which is in communication with the ejection port, and the electrothermal converter, provided in the liquid path. In the print head 5, a diode sensor 50 (see FIG. 2) as head temperature detector is provided on a board with the electrothermal converter provided thereon: the diode sensor 50 senses the temperature of the print head 5.

Figure 2:
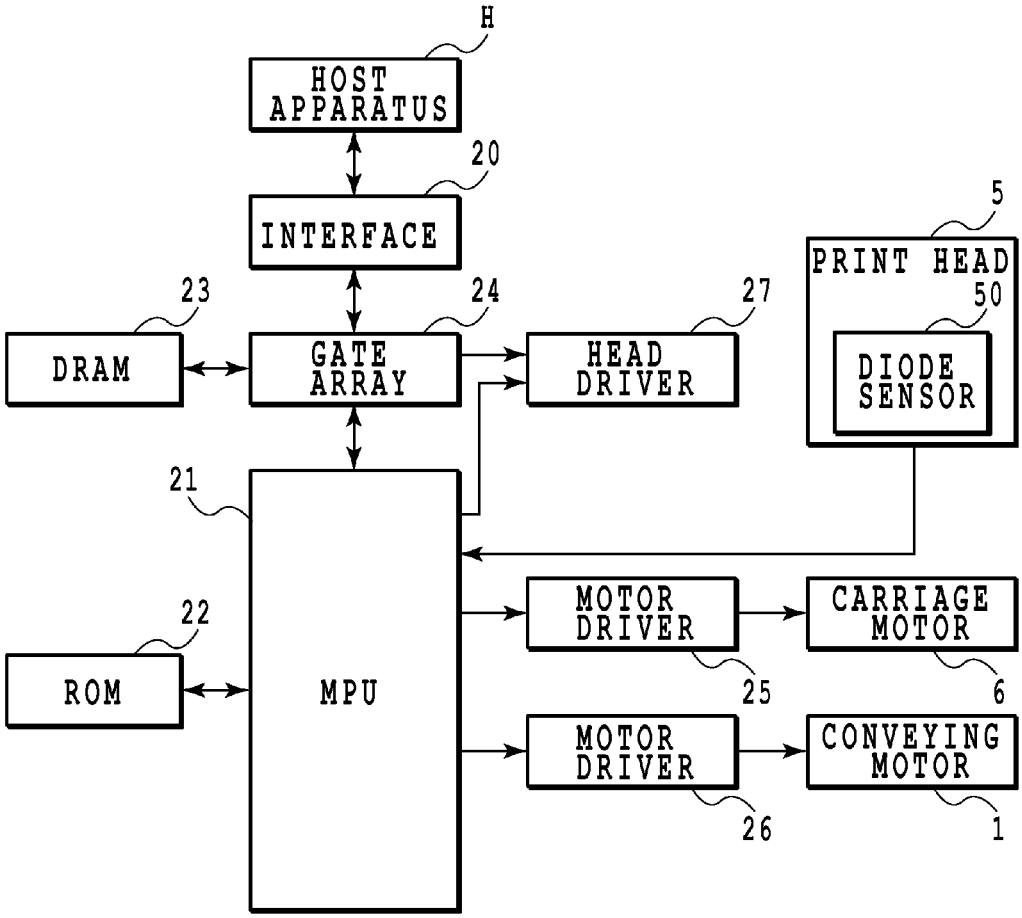
FIG. 2 is a block diagram illustrating the configuration of a control system of the ink jet printing apparatus that is applicable to the embodiment of the present invention.

FIG. 2 is a block diagram illustrating the configuration of a control system of the ink jet printing apparatus according to the present embodiment. In FIG. 2, reference numeral 20 denotes an interface that transmits and receives image data, control commands, or the like between a host apparatus H and the ink jet printing apparatus main body. Reference numeral 21 denotes an MPU which executes processes such as various calculations, determinations, and settings and which performs various control operations for the whole printing apparatus. Programs and fixed data required for the MPU to perform the control are stored in a ROM 22. Reference numeral 23 denotes a DRAM which temporarily stores various data (print data to be supplied to the print head 5) and which is utilized as a work area for processes executed by the MPU 21. The MPU 21, the ROM 22, and the DRAM 23 constitute controller, standby controller, scan count setting unit, and standby time setting unit according to the present invention.

Reference numeral 24 denotes a gate array that controls the supply of print data to the print head 5. The gate array 24 also controls data transfers between the interface 20 and the MPU 21 and the DRAM 23. Reference numeral 25 denotes a motor driver that drives a carriage motor 6. Reference numeral 26 denotes a motor driver that drives the conveying motor 1. Reference numeral 27 denotes a head driver that drives the print head 5. Output data (temperature value) from the diode sensor 50, which detects the temperature of the print head 5, is sent to the MPU 21.

A specific description will be given of a sequence of printing performed by the above-described printing apparatus.

Figure 3:
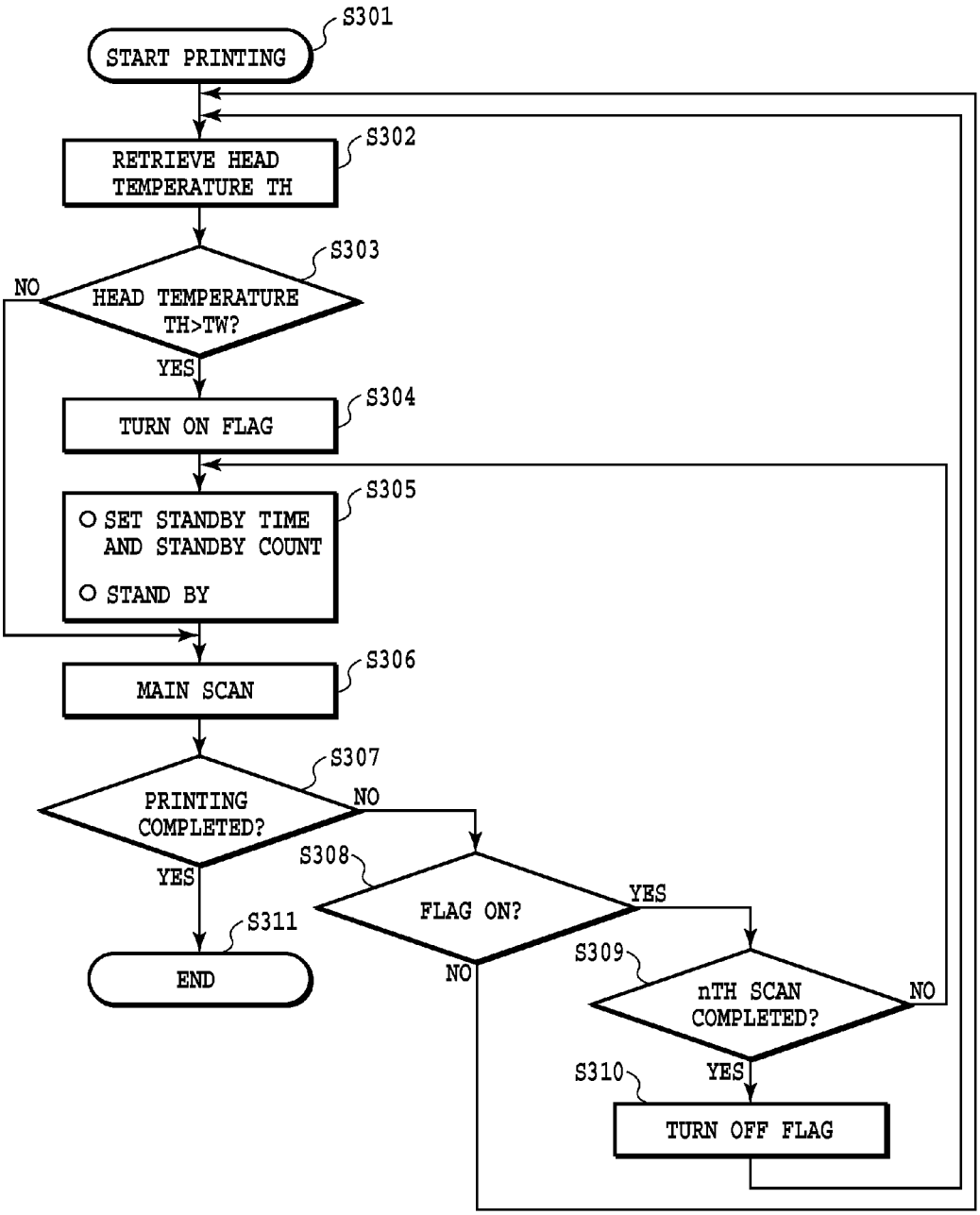
FIG. 3 is a flowchart illustrating a series of steps performed by an MPU to print one page of image according to the embodiment of the present invention.

FIG. 3 is a flowchart illustrating a series of steps executed by the MPU 21 in the printing apparatus according to the present embodiment to print one page of image.

First, in step S301, printing is started. A host apparatus H inputs image data including control data to the MPU 21 via the interface 20 and the gate array 24. In step S302, the MPU 21 retrieves the temperature of the print head 5 (hereinafter referred to as the head temperature TH) detected by the diode sensor 50. Then, the MPU 21 compares head temperature TH retrieved in the head temperature retrieving step with a predetermined threshold temperature (hereinafter referred to as a standby start temperature TW) pre-stored in the ROM 22 (step S303). Here, if the head temperature TH retrieved is equal to or lower than the standby start temperature TW (equal to or smaller than the threshold), the MPU 21 proceeds to step S306 to perform one print scan.

On the other hand, if the head temperature TH retrieved in step S303 is determined to be higher than the standby start temperature TW, the MPU 21 turns on a flag (standby flag) (step S304). The standby start temperature TW is set to a temperature at which a printing operation is to be temporarily suspended in order to prevent the head temperature from rising to a value at which a problem such as non-ejection is likely to occur. Specifically, the standby temperature in the printing apparatus applicable to the present embodiment is 66° C.

The MPU 21 sets the time for which scanning of the carriage stands by until the start of each of the subsequent print scans (standby time) and the number of print scans for which the amount of standby time until the start of the print scan is to be set. The MPU 21 causes the print scan to stand by for the standby time (step S305). In the present embodiment, in step S305, the standby time to be implemented and the number of print scans to stand by are set in accordance with a table shown in FIG. 4. The control causing the scanning of the carriage to stand by is hereinafter referred to as standby control.

As shown in FIG. 4, the printing apparatus according to the present embodiment sets the standby time and a set scan count according to the head temperature TH detected in step S303. In the table shown in FIG. 4, the head temperature is divided into three levels: 66° C. to 70° C., 71° C. to 75° C., and at least 76° C. The individual standby controls are performed for the respective levels. For example, if the head temperature TH detected in step S302 is within the range of 66° C. to 70° C., a standby time of 0.3 seconds is set for each of four print scans that are subsequently sequentially started. If the detected head temperature TH is within the range of 71° C. to 75° C., a standby time of 0.3 seconds is set for each of six print scans. If the detected head temperature TH is at least 76° C., a standby time of 0.3 seconds is set for each of eight print scans. Thus, in the present embodiment, for each temperature range, the amount of standby time until the start of each print scan is set to 0.3 seconds. The data in the table indicating the standby time and set scan count for the head temperature TH is pre-stored in the ROM 22. The MPU 21 references the table to set the standby time and the set scan count. The MPU 21 causes the scanning of the carriage 4 to stand by on the basis of the set scan count and standby time set on the basis of the table.

In step S305, the MPU 21 causes the scanning of the carriage to stand by for the set standby time, and then performs one print scan (step S306). That is, the MPU 21 drives the carriage motor 6 to move the carriage 4, while driving a head driver 27 to allow the print head 5 to eject ink in accordance with print data.

Once one line of print scan is completed through steps S305 and S306, the MPU 21 proceeds to step S307 to determine whether or not the last print scan has completed printing one page of image. If the MPU 21 determines that there is image data to be printed, the MPU 21 determines whether or not the standby flag is on (step S308). If the MPU 21 determines that the standby flag is off, the process returns to step S302, where the MPU 21 detects the head temperature TH during the next print scan. If the MPU 21 determines that the standby flag is on, the MPU 21 determines whether or not the number of scans that have performed a standby operation so far (actual scan count) has reached a scan count n (set scan count) determined on the basis of the table stored in the ROM 22 (step S309). Here, if the MPU 21 determines that the actual scan count has reached the set scan count (n), the MPU 21 turns off the flag (step S310) and the process returns to step S302. If the MPU 21 determines in step S309 that the actual scan count has not reached the set scan count (n), the MPU 21 proceeds to step S305 again to perform the subsequent print scan with the standby time set for the print scan. Subsequently, if the MPU 21 determines in step S307 that printing of one page of all the image data has been completed, the MPU 21 ends the printing operation (step S313).

FIG. 5 is a diagram showing the temperature of a print head which reached when an AO-sized image of 100% print rate was printed by a multipass printing method for four passes as well as a difference in optical density between an image area formed by performing standby control and an area printed without performing the standby control, according to the present embodiment. FIG. 5 also shows, as comparative examples for the present embodiment, a case in which the standby control is not performed regardless of the head temperature (comparative example 1) and a case in which if the head temperature exceeds the threshold temperature of 66° C., a standby time of 1 second is set only for the directly subsequent print scan (comparative example 2).

In FIG. 5, in comparative example 1, the standby control was not performed, and no density unevenness occurred in a printed image. However, the head temperature continued to rise as the printing operation progressed. The temperature finally reached 78° C. On the other hand, in comparative example 2, when the head temperature exceeds 66° C., a standby time of 1 second was set only for the directly subsequent scan. This inhibited an excessive increase in temperature, and the temperature of the print head was saturated at about 69° C. However, an optical density difference of about 0.06 occurred between the area printed with the standby control performed and the adjacent area printed without performing the standby control. Owing to this optical density difference, density unevenness was visually perceived.

In contrast, with the printing apparatus according to the present embodiment, the standby time is set to 0.3 seconds. An optical density difference of only about 0.02 occurred between the area printed with the standby control performed and the adjacent area printed without performing the standby control. The optical density difference of 0.02 is at a level at which the difference is not visually perceived. Thus, degradation of image quality caused by this optical density difference was not recognized.

If the temperature detected by the diode sensor 50 exceeds the threshold temperature of 66° C., a predetermined number of standby control operations are also performed in accordance with the table shown in FIG. 4. Thus, the head temperature can be kept equal to or higher than a given temperature. That is, once the head temperature reaches the range of 66° C. to 70° C., the print scan with the standby time is repeated four times. Once the head temperature reaches the range of 71° C. to 75° C., the print scan with the standby time is repeated six times. Once the head temperature reaches 76° C. or higher, the print scan with the standby time is repeated eight times. This control saturated the temperature of the print head at about 71° C. regardless of to which of the three temperature ranges the detected head temperature belonged. Thus, the present embodiment can sharply reduce the temperature of the print head compared to Comparative Example 1, in which the standby control is not performed. This makes it possible to reduce possible non-ejections. Furthermore, the reduced temperature of the head enables a reduction in damage to the print head caused by heat accumulation.

As described above, the ink jet printing apparatus according to the present embodiment detects the temperature TH of the print head during every print scan. If the head temperature TH exceeds the threshold temperature TW, the ink jet printing apparatus according to the present embodiment performs the standby control on each of the plurality of subsequent main scans. In this case, the number of scans to be subjected to the standby control is set to a value corresponding to the head temperature TH. That is, if the head temperature TH is high, the set scan count is increased to increase the number of times that heat is radiated from the print head 5. The temperature of the print head can thus be inhibited from increasing excessively, enabling a reduction in possible damage or non-ejection caused by heat from the print head.

The standby time set between the print scans is set to such a value as prevents a color difference from occurring between an image area printed after the standby control and an adjacent area printed without performing the standby control. This prevents density or hue evenness from being recognized in the image. Thus, the present embodiment can improve both the reliability of the apparatus and the quality of print images.

In the present embodiment, the standby time is set to 0.3 seconds. However, the standby time can be controllably changed to a more appropriate value according to the type of the print media used, a print mode, or various print conditions such as the number of ink ejections. This enables a further reduction in possible density or hue evenness, allowing the quality of images to be further improved.

Furthermore, the present embodiment performs control such that the head temperature TH is not retrieved while the standby flag is on. However, the head temperature TH can be retrieved even while the standby flag is on so that the number of subsequent standby control operations can be changed or the set scan count n can be reset after the acquisition to re-perform the standby control. By thus changing the set scan count as required in response to a change in head temperature, it is possible to precisely control the head temperature. Thus, the head temperature is more effectively inhibited from increasing excessively.

Moreover, the present embodiment performs control such that the number n of set scans is varied between a plurality of levels (in FIG. 4, the three levels) according to the head temperature. However, the present invention is not limited to this. The standby control can always be performed on a given number of scans regardless of the head temperature provided that the head temperature TH exceeds the threshold temperature. Moreover, the temperature of the print head can be more reliably inhibited from increasing excessively by performing control such that the number of scans (set scan count) to be subjected to the standby control is changed to an optimum value according to various print conditions.

Furthermore, in the present embodiment, if the head temperature TH exceeds the threshold temperature, the number n of set scans to be subjected to the standby control is varied between the plurality of (three) levels according to the head temperature. However, it is possible to preset the number of scans to be subjected to the standby control if the head temperature TH exceeds the threshold temperature so that the standby time for each of the preset plurality of scans can be changed according to the head temperature TH.

Additionally, the scans to be subjected to the standby control need not be consecutively performed. In the present embodiment, if the head temperature is between 66° C. and 70° C., the standby control is performed on the first to fourth scans. However, the standby control may be performed on every other scan, for example, on the first, third, fifth, and seventh scans.

(Second Embodiment)

Now, a second embodiment of the present invention will be described.

The second embodiment is characterized the standby time set for each scan to be subjected to the standby control is changed according to the head temperature TH and the number n of scans to be subjected to the standby control (scan count) The second embodiment is similar to the first embodiment in the other respects. Consequently, an ink jet printing apparatus according to the second embodiment also has the configuration shown in FIGS. 1 and 2.

FIG. 6 is a diagram showing a table used to set the standby time in the ink jet printing apparatus according to the present embodiment. The ink jet printing apparatus according to the second embodiment can set the amount of standby time until the start of each scan and the number of scans to be subjected to the standby control (set scan count). For example, if the head temperature is between 66° C. and 70° C. (first level), the scan count is controllably set to six. If the head temperature is between 71° C. and 75° C. (second level) or is equal to or higher than 76° C. (third level), the scan count is controllably set to eight.

Moreover, the second embodiment performs control such that the standby time is varied as the scans to be subjected to the standby control are sequentially performed. That is, for the scans to be subjected to the standby control, the standby time is set to a relatively small value if only a few scans have been performed. The standby time is increased once the scan count has reached a given value. A further increase in scan count reduces the standby time again. For example, the following control is performed. If the head temperature is at the first level (66° C. to 70° C.), a standby time of 0.1 second is set for the first and second scans. Subsequently, a standby time of 0.3 seconds is set for the third and fourth scans. Subsequently, the standby time set for the fifth and sixth scans is reduced to 0.1 second again.

Such a method of setting the standby time enables an effective reduction in possible density or hue unevenness between the areas formed by a plurality of print scans. The reason will be explained below. In the explanation below, a multipass printing method for two passes is taken by way of example, in which an image is completed by two scans performed on the same area on a print medium.

The multipass printing method for two passes completes one area, for example, by means of the first and second print scans. Similarly, the images in the four other areas are sequentially formed by every two print scans, that is, the second and third scans, the third and fourth scans, the fourth and fifth scans, and the fifth and sixth scans. In this case, there is only a small difference (0.1 second) in the standby time set for the formation of each area between an area formed by two print scans not involving the standby time and an adjacent area formed by two print scans involving the standby time.

That is, the areas each formed by the two print scans not involving the standby time include an area (area A) formed by a print scan immediately preceding the first print scan and a print scan immediately preceding the print scan immediately preceding the first print scan, and an area (area H) formed by the sixth print scan and the succeeding print scan. The areas located adjacent to the respective above-described areas and each formed by the two print scans involving the standby time include an area (area B) formed by the first print scan and a print scan immediately preceding the first print scan and an area (area G) formed by the fifth and sixth print scans. The areas A and B are adjacent to each other, and the areas G and H are adjacent to each other. The standby time between the two print scans forming the area A is 0. The standby time between the two print scans forming the area B is 0.1 second. The difference in the standby time set for the formation of each area between these two areas is 0.1 second. Consequently, almost no difference in hue or density occurs between the areas A and B and between the areas G and H. This prevents the occurrence of visually perceivable density or hue unevenness.

Also for the areas formed by the two print scans involving the standby time, no significant difference in standby time occurs between the adjacent areas. For example, an area (area D) formed by the second and third print scans is adjacent to an area (area C) formed by the first and second print scans. An area (area F) formed by the fourth and fifth print scans is adjacent to an area (area E) formed by the third and fourth print scans. Here, the standby time between the two print scans forming the area C is 0.1 second. The standby time between the two print scans forming the adjacent area D is 0.3 seconds. Thus, the difference in the standby time set for the formation of each area between these two areas is only 0.2 seconds. Similarly, the difference in standby time between the areas E and F is 0.2 seconds. Thus, also for the areas each formed by the two print scans involving the standby time, there is only a small difference in standby time between the adjacent areas. Consequently, almost no difference in hue or density occurs, preventing the occurrence of visually perceivable density or hue unevenness. Similarly, if the head temperature TH is either at the second level (between 71° C. and 75° C.) or at the third level (equal to or higher than 76° C.), control is performed such that no significant difference occurs in standby time between the adjacent areas. This minimizes possible defects such as image density and hue unevenness in the adjacent areas of the image formed by the print scans.

Furthermore, in the second embodiment, as the level of the head temperature TH increases, the number of standby control operations is controlled and the standby time is controllably gradually increased. For example, when the head temperature TH is at the first level (66° C. to 70° C.), a standby time of 0.1 second is set for the first and second scans. However, when the head temperature TH is at the second level (71° C. to 75° C.), the standby time is set to 0.2 seconds. When the head temperature TH is equal to or higher than 76° C., the standby time is set to 0.3 seconds. Thus, in the second embodiment, as the head temperature TH rises, the standby time is increased to increase the time for radiation step by step. The temperature of the head can thus be inhibited from increasing excessively. In the above description, the two-pass printing is performed. The method of setting the standby time according to the present embodiment can be used even if one area is formed by at least three scans and is effective for preventing an excessive increase in the temperature of the print head and reducing possible density and hue unevenness.

As described above, the second embodiment changes the amount of standby time until the start of each scan according to the head temperature and the set scan count and varies the set standby time step by step as more standby control operations are performed. Thus, the hue and density of the adjacent areas for each scan can be varied step by step, making it difficult to easily view density or hue unevenness resulting from a difference in standby time. Moreover, by performing control such that the number of set standby operations and the standby time are increased consistently with the head temperature, it is possible to minimize an increase in the temperature of the print head and the associated occurrence of defects.

The second embodiment performs control such that the amount of standby time set for each print scan to be subjected to the standby control is increased step by step and then reduced step by step. However, the method of setting the standby time is not limited to this. That is, the standby control has only to be performed so as to minimize the difference in standby time between the consecutive print scans and may be continuously varied. Moreover, it is possible to repeat control such that the standby time is increased step by step or continuously and then reduced step by step or continuously. In short, time setting may be performed so as to vary, step by step, a possible color difference between the adjacent ones of the areas sequentially formed by a plurality of scans.

Furthermore, in the description of the second embodiment, by way of example, if the head temperature exceeds the threshold temperature, control is performed such that the setting of the standby time is changed between the two or three levels. However, the present invention is not limited to this. If the head temperature exceeds the threshold temperature, only one standby time can be set. Alternatively, control can be performed such that the standby time is changed among more levels according to the head temperature. Moreover, in the above-described embodiment, the standby control is performed only if one threshold temperature is exceeded. However, a plurality of thresholds may be set so that the standby time can be set for each of the temperature ranges set on the basis of the respective thresholds. Furthermore, no threshold may be set so that the standby time is varied as required according to the head temperature. In short, the optimum standby time has only to be set according to the head temperature.

(Third Embodiment)

Now, a third embodiment of the present invention will be described with reference to FIGS. 7 and 8.

The head temperature may rapidly become high depending on the structure of the print head or the number of ejections from the print head per unit time. In this case, the head temperature may fail to decrease sufficiently or rise when only the standby control is performed in which a short standby time is set for each of a plurality of scans as in the case of the above-described embodiments. If such a phenomenon occurs, the print head may fail to achieve ejection, significantly degrading the image quality. Thus, in the third embodiment, when the temperature of the print head becomes very high, a long standby time (for example, 1 second) is set for a single print scan to rapidly lower the head temperature TH to avoid possible non-ejection. The ink jet printing apparatus according to the third embodiment also has the configuration shown in FIGS. 1 and 2.

Figure 7:
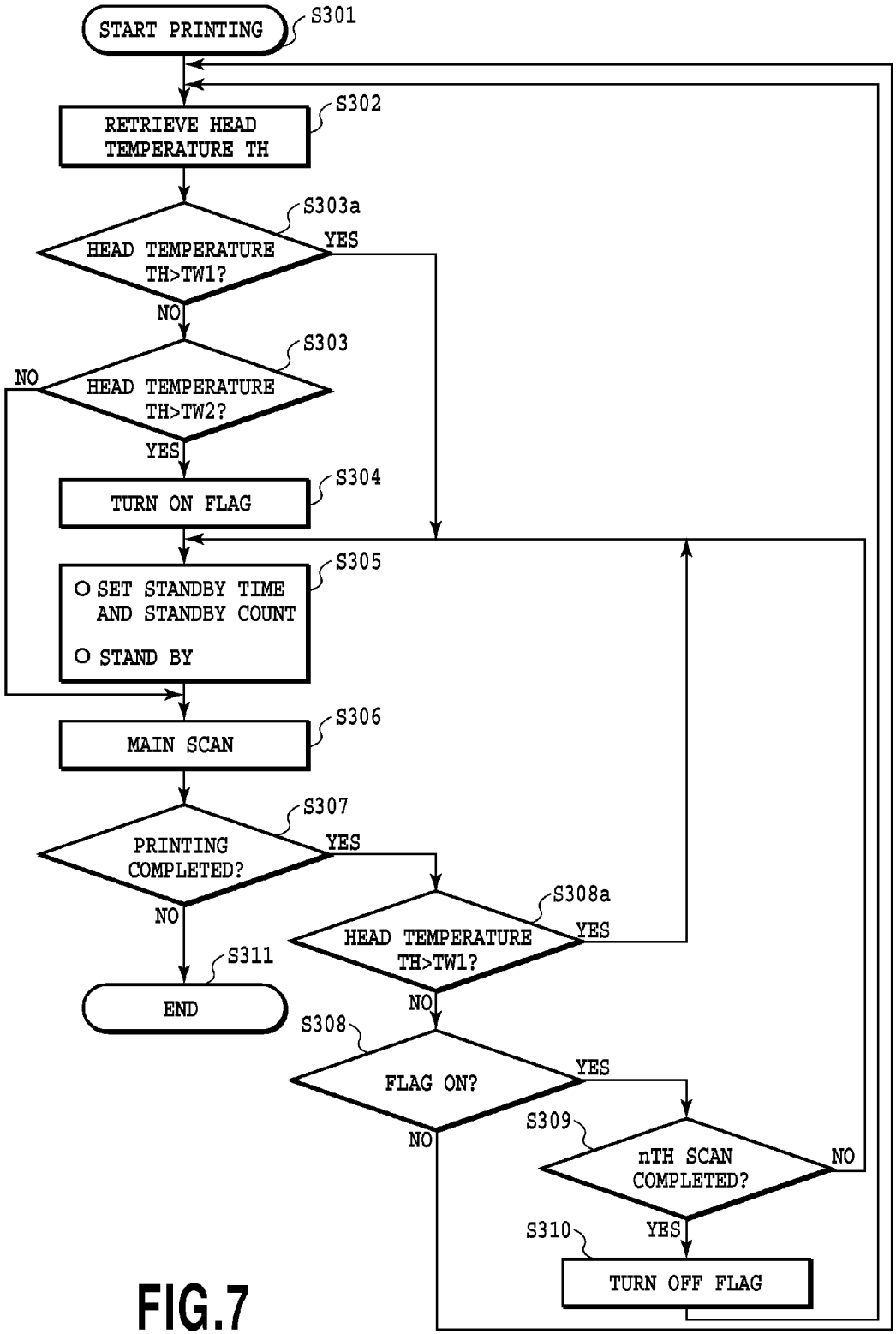
FIG. 7 is a flowchart illustrating a series of steps performed by an MPU to print one page of image according to a third embodiment of the present invention.

FIG. 7 is a flowchart illustrating a series of steps executed by the MPU 21 to print one page of image according to the third embodiment.

As shown in FIG. 7, in the third embodiment, steps S303*a* and S308*a* are added to the control shown in the flowchart in FIG. 3. That is, after retrieving the head temperature TH, the MPU 21 determines in step S303*a* whether or nor the head temperature exceeds a threshold TW1 (for example, 80° C.) that is much larger than the threshold (defined as TW2 herein) set in the above-described embodiments. If the MPU 21 determines that the head temperature TW does not exceed the threshold TW1, then the MPU 21 determines whether or not the head temperature TH exceeds the threshold TW2. Control based on the determinations is similar to that in the above-described first embodiment. That is, if the head temperature TH is equal to lower than the threshold TW2, the MPU 21 allows the print head to perform a main scan in step S306. If the head temperature TH exceeds the threshold TW2, then in step S305, the MPU 21 sets the standby time (0.3 seconds) and a standby count corresponding to the head temperature in accordance with a table shown in FIG. 9. The print head performs the main scan in accordance with the settings (step S306).

On the other hand, if the MPU 21 determines in step S303*a* that the head temperature TW exceeds the threshold TW1, the MPU 21 shifts to step S305. In step S305, in accordance with the table shown in FIG. 9, the MPU 21 sets the standby count to 1 to cause the next single scan to stand by for 1 second. The table shown in FIG. 9 shows different set scan counts, 4, 6, 8, and 1 corresponding to 4 levels of temperatures, 66° C. to 70° C., 71° C. to 75° C., 76° C. to 79° C., and 80° C. or higher. For three levels set for the range of 66° C. to 79° C., the amount of standby time until the start of each scan is uniformly set to 0.3 seconds. However, a standby time of 1 second is set for the head temperature TH of at least 80° C.

After the main scan, the MPU 21 determines in step S307 whether or not the step printing operation has been completed. If the printing operation has not been completed, the MPU 21 determines whether or not the head temperature TH exceeds the threshold T1 (80° C.). If the MPU 21 determines that the head temperature exceeds the threshold T1, the MPU 21 shifts to step S305 to set the standby time to 1 second and the standby count to 1. Then, after the standby time of 1 second elapses, a main scan is performed in step S306. Subsequently, if the MPU 21 determines in step S307 that the printing operation has not been completed yet, then in step S308*a*, the MPU 21 determines again whether or not the head temperature TH exceeds the threshold TW1. If the head temperature TH does not exceed the threshold TW1, the MPU 21 determines in step S308 whether or not the flag is on. If the flag is on, the MPU 21 determines in step S305 whether or not the set n scans have been completed (S309). If the head temperature TH exceeds TW1 after the last scan, the scan count has been set to 1 in step S305 and this scan has already been performed in step S306. Thus, in this case, after the determination in step S309, the MPU 21 shifts to step S310 to turn off the flag. The MPU 21 subsequently shifts to step S302 to retrieve the head temperature TH again.

As described above, in the third embodiment, if the head temperature TH is higher than the threshold TW2 and is equal to or lower than the threshold TW1, a standby time of 0.3 seconds is set for each of a plurality of scans set according to the head temperature as is the case with the first embodiment. However, if the head temperature TH is higher than the threshold TW1, a long standby time of 1 second is set. Thus, during this period, the temperature of the print head can be sufficiently reduced, making it possible to reliably inhibit possible non-ejection caused by an excessive increase in the temperature of the print head.

In the third embodiment, if the head temperature TH is equal to or lower than the threshold TW2, a standby time of 0.3 seconds is uniformly set for each of the scans to be subjected to the standby control as is the case with the first embodiment. However, also in the third embodiment, the standby time for each of the scans to be subjected to the standby control can be varied according to the progress of the scans as is the case with the second embodiment.

Furthermore, the third embodiment also performs control such that the head temperature TH is not retrieved while the standby flag is on. However, the head temperature TH can be retrieved even while the standby flag is on so that the number of subsequent standby control operations can be changed or the set scan count n can be reset after the retrieving of the head temperature to re-perform the standby control.

(Other Embodiments)

In the description of the above-described embodiments, bidirectional printing is performed in which the print head ejects ink both when moving forward and when moving backward. However, the present invention is applicable to what is called unidirectional printing in which the print head ejects ink only when moving forward or backward. That is, with the unidirectional printing, during a scan in which ink ejection is not performed (return scan), the carriage is moved faster than during a scan in which ink ejection is performed. Consequently, the temperature of the print head often fails to decrease even with the return scan period. Therefore, standby control such as that according to the present invention is effective on the unidirectional printing as is the case with the above-described embodiments.

In the above description of the ink jet printing apparatus according to the embodiments, the electrothermal converting elements provided in the nozzles in the print head generate thermal energy to generate bubbles in the liquid in the nozzles so that the pressure of the bubbles causes the ink to be ejected. However, the present invention is not limited to the use of the electrothermal converting elements. The present invention is applicable to a printing apparatus using, for printing, a print head having electromechanical converting elements such as piezo elements in nozzles.

In the above described embodiments, as a form in which the print head performs scanning relative to the print medium, the example is described in which the print head is reciprocated while performing scanning. However, of course, the present invention is applicable to a form in which the print medium is reciprocated relative to the print head for printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-148631, filed Jun. 4, 2007, which is hereby incorporated by reference herein in its entirety.

What is claimed is:

1. An ink jet printing apparatus comprising:

a print head for ejecting ink for printing;

a scanning unit configured to scan the print head relative to a print medium;

an obtaining unit configured to obtain information relating to a temperature of the print head in a target scan of the print head by the scanning unit; and a control unit configured to control the scanning unit so as to delay scanning of the print head by providing a delay time between a previous scan and a next scan based on the information obtained by the obtaining unit in the target scan, wherein the control unit delays scanning by providing the delay time for a determined plurality of intervals between scans after the target scan when the temperature of the print head in the target scan indicated by the information is higher than a predetermined temperature such that a first delay time for one interval of the determined plurality of intervals is shorter than a second delay time for another interval of the determined plurality of intervals later than the one interval.

2. The ink jet printing apparatus according to claim 1, wherein the control unit sets a length of each of the delay times for the determined plurality of intervals between scans.

3. The ink jet printing apparatus according to claim 2, wherein the control unit sets the lengths of the delay times for the determined plurality of intervals such that the length of the delay times for intervals for a first half of two or more scans becomes gradually longer as the scans progress, and the length of the delay times for intervals for a second half of the two or more scans becomes gradually shorter as the scans progress.

4. The ink jet printing apparatus according to claim 2, wherein the control unit sets the lengths of the delay times according to a print condition.

5. The ink jet printing apparatus according to claim 4, wherein the print condition is the number of ink ejections from the print head for each scan.

6. The ink jet printing apparatus according to claim 1, wherein the number of the determined plurality of scans for which to delay scanning by the scanning unit when the temperature indicated by the information is higher than the predetermined temperature and lower than a threshold temperature is greater than the number of the determined plurality of scans for which to delay scanning by the scanning unit when the temperature is not lower than the threshold temperature.

7. The ink jet printing apparatus according to claim 6, wherein when the temperature indicated by the information is higher than the threshold temperature which is higher than the predetermined temperature, the control unit delays one scan, immediately subsequent to the target scan, with a delay time that is longer than the delay time for each of the delayed scans when the temperature is higher than the predetermined temperature and lower than the threshold temperature.

8. The ink jet printing apparatus according to claim 6, wherein when the temperature indicated by the information is higher than a second threshold temperature which is higher than the threshold temperature, the control unit delays one scan, immediately subsequent to the target scan, with a delay time longer than the delay time for each of the delayed scans when the temperature is higher than the threshold temperature and lower than the second threshold temperature.

9. The ink jet printing apparatus according to claim 1, wherein the print head generates thermal energy for ejecting ink.

10. The ink jet printing apparatus according to claim 1, wherein the control unit sets a first duration for the delay times if the temperature indicated by the information is equal to or higher than a first temperature and lower than a second temperature, and the control unit sets a second duration, which is longer than the first duration, for the delay times if the temperature indicated by the information is equal to or higher than the second temperature.

11. The ink jet printing apparatus according to claim 1, wherein the control unit does not set subsequent delayed scans until the scanning unit has scanned the print head the determined plurality of times.

12. The ink jet printing apparatus according to claim 1, wherein the control unit can change the determined plurality of times based on the temperature of the print head, the temperature being retrieved while the scanning unit is scanning the print head during the determined plurality of times.

13. An ink jet printing method for printing by using an ink jet printing apparatus which has a print head to eject ink for printing and a scanning unit to scan the print head relative to a print medium, the method comprising steps of:

obtaining information relating to a temperature of the print head in a target scan of the print head by the scanning unit; and controlling the scanning unit so as to delay scanning of the print head by providing a delay time between a previous scan and a next scan based on the information obtained by the obtaining step in the target scan, wherein the control step delays scanning by providing the delay time for a determined plurality of intervals between scans after the target scan when the temperature of the print head in the target scan indicated by the information is higher than a predetermined temperature such that a first delay time for one interval of the determined plurality of intervals is shorter than a second delay time for another interval of the determined plurality of intervals later than the one interval.

14. The ink jet printing method according to claim 13, wherein the controlling step sets a length of each of the delay times for the determined plurality of intervals between scans.

15. The ink jet printing method according to claim 13, wherein the number of the determined plurality of scans for which to delay scanning by the scanning unit when the temperature indicated by the information is higher than the predetermined temperature and lower than a threshold temperature is greater than the number of the determined plurality of scans for which to delay scanning by the scanning unit when the temperature is not lower than the threshold temperature.

16. The ink jet printing method according to claim 13, wherein the controlling step does not set subsequent delayed scans until the scanning unit has scanned the print head the determined plurality of times.

17. The ink jet printing method according to claim 13, wherein the controlling step can change the determined plurality of times based on the temperature of the print head, the temperature being retrieved while the scanning unit is scanning the print head during the determined plurality of times.

18. An ink jet printing apparatus comprising:

a print head for ejecting ink on a print medium;

a moving unit configured to move the print head plural times relative to the print medium and cause the print head to eject ink on the print medium in each movement over the print medium for printing on the print medium;

an obtaining unit configured to obtain information relating to a temperature of the print head in a predetermined movement of the print head effected by the moving unit; and a control unit configured to control the moving unit so as to delay a start of the movement for the printing by providing a delay time for intervals between sequential movements according to the temperature of the print head indicated by the information obtained by the obtaining unit in the predetermined movement, wherein the control unit delays starts of a plural number of the movements after the predetermined movement, in which the obtaining unit obtains the information, based on the information such that a first delay time for one movement is shorter than a second delay time for another movement later than the first movement.

19. The ink jet printing apparatus according to claim 18, wherein when the control unit sets the plural number of the movements in which to delay the start of the movements by the moving unit, the control unit sets lengths of each of the delay times for intervals between the sequential movements.

20. The ink jet printing apparatus according to claim 19, wherein the control unit sets the lengths of the delay times such that the lengths of the delay times for at least a part of a first half of two or more movements becomes gradually longer as the movements progress, and the lengths of the delay times for at least a part of a second half of the two or more movements becomes gradually shorter as the movements progress.

21. The ink jet printing apparatus according to claim 19, wherein the control unit sets the lengths of the delay times according to a print condition.

22. The ink jet printing apparatus according to claim 21, wherein the print condition is a number of ink ejections from the print head for each movement.

23. The ink jet printing apparatus according to claim 18, wherein the number of movements for which to delay the start of the movements by the moving unit when the temperature indicated by the information is higher than a predetermined temperature and lower than a threshold temperature is greater than the number of movements for which to delay the start of the movements by the moving unit when the temperature is not lower than the threshold temperature.

24. The ink jet printing apparatus according to claim 23, wherein when the temperature indicated by the information is higher than the threshold temperature which is higher than the predetermined temperature, the control unit delays the start of a movement immediately subsequent to the predetermined movement with a delay time that is longer than the delay time for each of the delayed starts of the movements when the temperature is higher than the predetermined temperature and lower than the threshold temperature.

25. The ink jet printing apparatus according to claim 23, wherein when the temperature indicated by the information is higher than a second threshold temperature which is higher than the threshold temperature, the control unit delays the starts of a movement immediately subsequent to predetermined movement with a delay time longer than the delay time for each of the delayed starts of the movements when the temperature is higher than the threshold temperature and lower than the second threshold temperature.

26. The ink jet printing apparatus according to claim 18, wherein the print head generates thermal energy for ejecting ink.

27. The ink jet printing apparatus according to claim 18, wherein the control unit sets a first duration for the delay times if the temperature indicated by the information is equal to or higher than a first temperature and lower than a second temperature, and the control unit sets a second duration, which is longer than the first duration, for the delay times if the temperature indicated by the information is equal to or higher than the second temperature.

28. The ink jet printing apparatus according to claim 18, wherein the control unit does not set subsequent delayed starts of the movement until the moving unit has moved the print head the plural number of movements.

29. The ink jet printing apparatus according to claim 18, wherein the control unit changes the plural number of the movements in which delayed starts are determined based on the temperature of the print head, the temperature being based on the temperature of the print head indicated by the information obtained by the obtaining unit in the predetermined movement, the start of the predetermined movement having been delayed by the control unit.

30. The ink jet printing apparatus according to claim 18, wherein the control unit resets the plural number of the movements in which delayed starts are determined based on the temperature of the print head indicated by subsequent information obtained by the obtaining unit in a subsequent movement in which a start is delayed by the control unit, and determines again the number of the movements in which the starts are to be delayed based on the temperature of the print head indicated by the subsequent information obtained by the obtaining unit.

31. The ink jet printing apparatus according to claim 1, wherein the control unit delays scanning by providing the delay times for the determined plurality of intervals, such that a third delay time for a third interval later than the other interval is shorter than the second delay time.

32. The ink jet printing apparatus according to claim 1, wherein the first interval is set for a first scan that the control unit controls based on the information obtained by the obtaining unit in the target scan.

33. The ink jet printing apparatus according to claim 1, wherein the print head has a sensor for sensing the temperature, and wherein the obtaining unit retrieves the information on the temperature by using the sensor.

34. The ink jet printing apparatus according to claim 18, wherein the control unit delays starts of a plural number of the movements after the predetermined movement such that a third delay time for a third movement later than the other movement is shorter than the second delay time.

35. The ink jet printing apparatus according to claim 18, wherein the first delay time is set for a start of a first movement that the control unit delays based on the information obtained by the obtaining unit in the predetermined movement.

36. The ink jet printing apparatus according to claim 34, wherein the second delay time is set for a start of last movement that the control unit delays based on the information obtained by the obtaining unit in the predetermined movement.

37. The ink jet printing apparatus according to claim 18, wherein the print head has a sensor for sensing the temperature, and wherein the obtaining unit retrieves the information relating to the temperature by using the sensor.

38. An ink jet printing apparatus comprising:

a print head for ejecting ink on a print medium;

a moving unit configured to move the print head plural times relative to the print medium and cause the print head to eject ink on the print medium in each movement over the print medium for printing on the print medium;

an obtaining unit configured to obtain information relating to a temperature of the print head in a predetermined movement of the print head effected by the moving unit; and a control unit configured to control the moving unit so as to delay a start of the movements for printing by providing delay times for intervals between sequential movements according to the temperature of the print head indicated by the information obtained by the obtaining unit in the predetermined movement, wherein the control unit delays starts of a plural number of the movements after the predetermined movement, in which the obtaining unit obtains the information, based on the information such that a delay time for a next movement later than a previous movement is shorter than a delay time for the previous movement.

39. The ink jet printing apparatus according to claim 18, wherein all of the predetermined movement and the plural number of the movements are movements for printing a same page of the print medium.

* * * * *